US006342685B1

(12) United States Patent
Perret

(10) Patent No.: US 6,342,685 B1
(45) Date of Patent: Jan. 29, 2002

(54) DOUBLE MOVEMENT HIGH VOLTAGE CIRCUIT BREAKER

(75) Inventor: Michel Perret, Tramole (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/674,353

(22) PCT Filed: Feb. 29, 2000

(86) PCT No.: PCT/FR00/00497

§ 371 Date: Dec. 13, 2000

§ 102(e) Date: Dec. 13, 2000

(87) PCT Pub. No.: WO00/52721

PCT Pub. Date: Sep. 8, 2000

(30) Foreign Application Priority Data

Mar. 1, 1999 (FR) ..... 99 02491

(51) Int. Cl.[7] ..... H01H 33/70
(52) U.S. Cl. ..... 218/78; 218/154
(58) Field of Search ..... 218/43, 78, 84, 218/153, 154

(56) References Cited

U.S. PATENT DOCUMENTS 4,342,891 A 8/1982 Solver 5,561,280 A * 10/1996 Blatter ..... 218/59

FOREIGN PATENT DOCUMENTS

| | | |
|---|---|---|
| EP | 0 540 971 A1 | 5/1993 |
| FR | 2 456 380 | 12/1980 |
| FR | 2 755 293 | 4/1998 |

* cited by examiner

*Primary Examiner*—Lincoln Donovan
(74) *Attorney, Agent, or Firm*—Sughrue Mion, PLLC

(57) ABSTRACT

Each pole of the circuit-breaker includes a case (1) containing two fixed conductive tubes (3, 4) which are aligned around an area provided for the pole contacts and each of which is connected to a connecting terminal. A semi-moving assembly includes a permanent contact member formed by the outside of a cylindrical member (6) adapted to slide in a permanent contact member (9) of a moving assembly and in the tube (4). That member is carried by a member (5) sliding in the tube (3) which carries a wear contact member (10, 11) penetrating axially into an arc blast nozzle (13) to which dielectric gas is fed by a piston (19). A drive rod (21) is moving between an inserted position in which the contacts are interconnected and another position in which they are separated. It operates through linkages to drive the assemblies and the piston differently.

7 Claims, 7 Drawing Sheets

"Closed position"

"Closed position"

"First opening stage"

"Intermediate opening stage"

"Intermediate opening stage"

"Intermediate opening stage"

DOUBLE MOVEMENT HIGH VOLTAGE CIRCUIT BREAKER

BACKGROUND OF THE INVENTION

The invention relates to a high-voltage circuit-breaker with dual motion of the contacts and incorporating an insulating gas puffer system with a semi-moving piston and optionally a closure resistance inserter.

High-voltage circuit-breakers with dual motion of the contacts are known in the art, and one example is described in the document FR-A-2 737 937 in particular. A high break capacity can be obtained with those circuit-breakers because the dual-motion feature means that their contacts move in opposite directions, which leads to fast separation of the contacts when the circuit-breaker opens.

An insulative gas puffer system is provided for fast extinction of the electrical arc that is formed between the arcing contacts if they separate when the circuit-breaker is live. The insulative gas used to extinguish the arc is conventionally compressed by a piston, and this compression operation cannot be instantaneous. It is therefore difficult to obtain optimum compression with prior art dual-motion circuit-breakers, because the movement of the compressor piston in those devices is mechanically linked to the faster movements of the circuit-breaker contacts. The resulting solutions are therefore unsatisfactory.

For example, opening the contacts of a circuit-breaker by moving the compression piston and the moving contact assembly of the circuit-breaker in opposite directions to accelerate the compression of the insulating gas for blowing out the arc when the circuit-breaker opens is known in the art.

However, such movement causes stresses and forces which compromise good operation of the compression chamber.

Another consequence of this is that the duration of closure resistance insertion is too short for a circuit-breaker in a long high-voltage network and having poles in which the symmetrical dual motion is obtained by a rack system, if a resistance inserter device in series with the contacts is associated with each pole to limit the surges that occur on closing the circuit-breaker.

SUMMARY OF THE INVENTION

The invention therefore proposes a dual-motion multipole circuit-breaker in which the speed of the compressor piston and the speeds of each of the moving and semi-moving contact assemblies are different. Each pole of the circuit-breaker includes a case defining a break chamber designed to be filled with dielectric gas and containing a fixed assembly including two aligned conductive tubes on respective opposite sides of a central area provided for the pole contacts and each connected to a different external connection terminal, said contacts being divided between two complementary moving contact assemblies moving in translation along a common axis XX' and interconnected successively by two coaxial annular contacts, namely a wear contact and a permanent contact. One of the two assemblies constitutes a semi-moving assembly and has a permanent contact member consisting of the outside wall of a first cylindrical conductive member adapted to slide inside the annular permanent contact member of the other assembly, referred to as the moving assembly, and in one of the fixed tubes to which that member is electrically connected, via its wall. The annular permanent member of the moving assembly is carried by another cylindrical conductive member adapted to slide in the other fixed tube to which that other member is electrically connected, as well as a wear contact member consisting of a conductive termination mounted at the end of a conductive support rod fixed axially inside said other conductive member. The rod is adapted to penetrate axially into an arc blast nozzle, which it then blocks and which defines an arc expansion volume around a wear contact member complementary to the conductive termination and carried axially by the first conductive member of the semi-moving assembly, as well as the nozzle which is fixed to the end of that first member at the border of the volume. The latter is adapted to be filled with gas through a wall which separates it from a compression chamber formed in the first conductive member between that wall and a compressor piston moved with the two assemblies.

According to a feature of the invention, the circuit-breaker includes a drive rod disposed axially in the pole including it and movable in translation between a fully inserted position in which the contacts of the assemblies are interconnected and a fully open position in which the contacts are separated. The drive rod carries the first member of the semi-moving contact assembly that it drives when it moves and co-operates with a first linkage through which said other member of the moving assembly is driven. The linkage is adapted, when the drive rod is pulled from its fully inserted position, to cause in succession an initial displacement of the two assemblies in the same direction as the rod, followed by movement of the moving assembly in the opposite direction to the semi-moving assembly, after said moving assembly has stopped and until the drive rod reaches its open position, after separation of the contacts. The drive rod co-operates with a second linkage which drives the compressor piston in the opposite direction relative to said first member, on which it slides, until the contacts are separated.

According to a feature of the invention, the first linkage is adapted to move the two assemblies at the same speed in opposite directions when the contacts are separated.

According to a feature of the invention, the first linkage includes:

- a first shaft mounted transversely on the drive rod near the actuator end of that rod,
- a second shaft mounted transversely on the tube through which the rod passes, the rod incorporating a longitudinal opening through which the shaft passes,
- a system including at least one relatively long shaft actuator link and one relatively short shaft actuator link which are articulated and connect the first and second shafts so that any movement of the rod causes corresponding rotation of the second shaft, and
- a system including at least one relatively short moving assembly drive link and one relatively long link connecting the second shaft to a shaft fastened to said other conductive member which carries the moving assembly to move it as indicated.

According to a feature of the invention, the relatively long and relatively short shaft actuator and moving assembly drive links are provided in pairs and form two sub-assemblies on respective opposite sides of the drive rod.

According to a feature of the invention, a relatively long shaft actuator link is cranked where it bears against the second shaft in the fully inserted position of the drive rod in which the contacts are interconnected and in which a relatively short moving assembly drive link is at an obtuse angle to the corresponding relatively short shaft actuator link at the second shaft to which they are fixed, so that the two shafts carried by each of them are on the same side of the drive rod when the drive rod is in the fully inserted position and the relatively short shaft actuator link extends beyond the rod after limited displacement of the drive rod from the fully inserted position.

According to a feature of the invention, the second linkage includes:

a drive shaft mounted transversely on the drive rod, and a system including at least one relatively long compression link and two relatively short compression links articulated to a common shaft, said relatively long compression link being also articulated centrally to the compressor piston and the relatively short compression links being respectively articulated to the drive shaft and to a fixed shaft.

According to a feature of the invention, the circuit-breaker includes a pair of relatively long compression links and two pairs of relatively short compression links which form two sub-assemblies on respective opposite sides of the tube containing the drive rod.

BRIEF DESCRIPTION THE DRAWINGS

The invention, its features and its advantages are explained in the following description, which is given with reference to the figures referred to below.

DETAILED DESCRIPTION OF THE INVENTION

Figure 1:
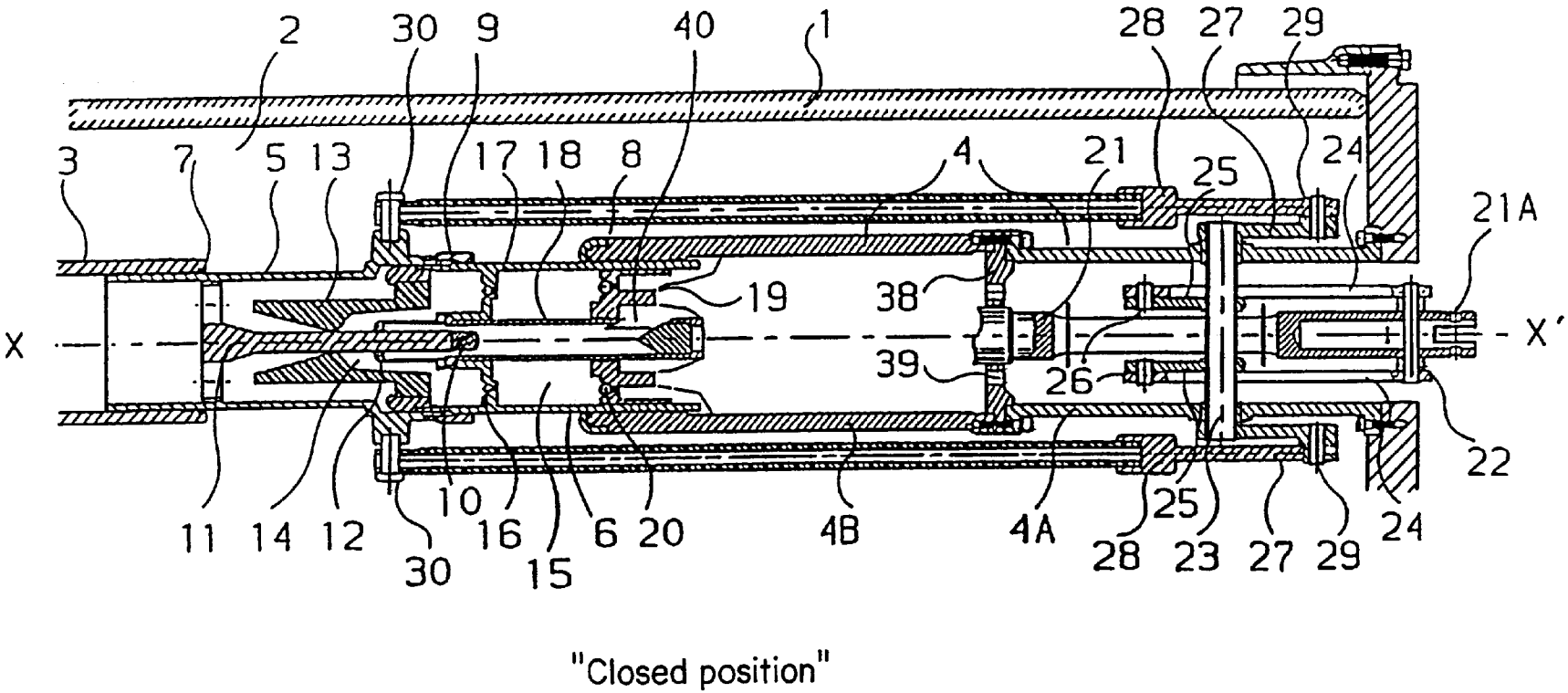
FIGS. 1 and 2 are two partial longitudinal sections in mutually perpendicular planes of a circuit-breaker pole according to the invention, in the closed state.

The figures show one pole of a multipole high-voltage (for example 550 kV) circuit-breaker.

That pole includes a cylindrical case 1, only part of which is shown, and which is made of an insulative material, for example porcelain, or of metal in the case of a metal-clad circuit-breaker. The case is closed at its ends in a conventional way, not shown. It defines a break chamber 2 designed to be filled with a pressurized dielectric gas, routinely at a pressure of the order of a few bars. The chamber 2 includes a fixed assembly including two tubes 3 and 4 made from a metal that is a good conductor and which are aligned along the longitudinal axis XX' of the case on respective opposite sides of a central area of the case adapted to receive the pole contacts. Each contact is connected to a respective external connecting terminal of the pole, not shown. Two moving and complementary contact assemblies are each carried by one of the tubes 3, 4, relative to which they slide in the direction of the axis XX', either towards each other to interconnect them or away from each other to disconnect them.

Each contact assembly includes a cylindrical conductive member 5 or 6 which can move in translation relative to the tube 3 or 4 carrying it. To this end each of the tubes 3, 4 has an annular contact bearing surface 7 or 8 inside which a tubular portion of one of the two members 5, 6 slides longitudinally, so that there is electrical continuity between each of those members and the tube on which it slides. Note that in the embodiments shown the tube 4 consists of two sections 4A, 4B mounted end-to-end, for convenience.

The two contact assemblies are successively interconnected by an arc or wear contact and a permanent contact, which contacts are annular and coaxial. This is known in the art. Peripheral permanent contact is established between the outside of the cylindrical tube constituting the conductive member 6, which projects out of the tube 4, and an annular permanent contact member 9 carried inside the conductive member 5, in this example at the end which projects out of the tube 3. Peripheral wear contact is established between the outside of a conductive termination 10 mounted at the end of a support rod 11 disposed axially inside the cylinder constituting the conductive member 5 and a complementary wear contact member 12 which carries the conductive member 6 inside it, near the end projecting out of the tube 4.

In the proposed embodiment, the wear and permanent contact members carried by the member 5 are positioned to project the same distance from that member. The wear contact member projects beyond the end of the member 6, as can be seen in the various figures.

The termination 10 and the wear contact member 12 are made of a conductive material, such as tungsten, chosen for its ability to resist erosion by electrical arcing. This is known in the art.

The rod 11, which carries the termination 10 at one end, is a cylindrical conductive rod in this example and is electrically connected to the member 5 inside which it is axially fixed. It passes longitudinally through an arc blast nozzle 13 mounted at the end of the conductive member 6 and positioned inside the tube formed by the member 5 when the two contact assemblies are interconnected.

The arc blast nozzle 13 is of a type known in the art and its function is not described here. It defines an arc expansion volume 14 whose edge is fixed internally to the end of the tube formed by the member 6 projecting out of the tube 4. The volume 14 surrounds the wear contact member 12, which is mounted inside the tube formed by the member 6, to the rear of the blast nozzle relative to the end of that member at which the nozzle is mounted. The volume 14 then surrounds the end area of the member 12, where the electrical arcs are likely to be formed, until the circuit-breaker has opened. Its rear end is then closed by the rod 11 which passes through it and its other end can communicate with a gas compression chamber 15 via valves 16 carried by a separator wall 17 positioned transversely in the tube formed by the member 6.

In the embodiment shown, the separator wall 17 is part of a circular member fixed to the rear of the member 12 in the tube formed by the member 6 and/or to a hollow rod 18 that carries the member 12 and which passes axially through the member 6.

The compression chamber 15 lies between the inside wall of the tube forming the member 6 and the outside wall of the rod 18. It is laterally defined by the separator wall 17 and by an annular compressor piston 19 which slides simultaneously inside the tube forming the member 6 and on the rod 18. The piston 19 has valves 20 which enable a flow of dielectric gas to fill the compression chamber 15 between gas compression phases. The hollow rod 18 communicates with the volume 14 via the central circular opening defined by the member 12 when that opening is not blocked by the termination 10 or by the rod 11 carrying it. This enables the pressurized dielectric gas contained in the expansion volume to escape via the hollow rod 18 and through the central circular opening defined by the member 12 and at least one evacuation opening 50 formed laterally in the hollow rod in an area covered by the piston 19 when it is in a retracted position, the circuit-breaker is closed and the contact assemblies are interconnected.

In the embodiment considered, the hollow rod 18 is mounted in alignment with a drive rod for driving the assemblies and the piston 21 to whose end it is fixed. The drive rod 21 is disposed axially in the pole which incorporates it and can be moved in translation along the longitudinal axis XX' of the pole between two extreme positions by an opening/closing drive system, not shown. That system alternately pulls or pushes on one end of the drive rod 21A which projects out of the case 1 to drive co-ordinated movements of the pole contact assemblies.

The movements of the semi-moving pole contact assembly reproduce those of the drive rod 21 which carries it, the assembly essentially comprising the permanent contact member consisting of the tubular outside wall of the member 6 and the wear contact member 12 fixed internally to the end of the rod 18, inside the member 6.

Movement of the moving pole contact assembly is driven by a first drive linkage which is preferably symmetrical about the drive rod, or to be more precise about a longitudinal median plane of the pole whose axis is the axis XX'. A second linkage drives movements of the compressor piston 19 linked to the movements of the contact assemblies, and is also preferably symmetrical about a longitudinal median plane of the pole whose axis is the axis XX', and in this example this plane of symmetry is the same as that of the first linkage.

Figure 2:
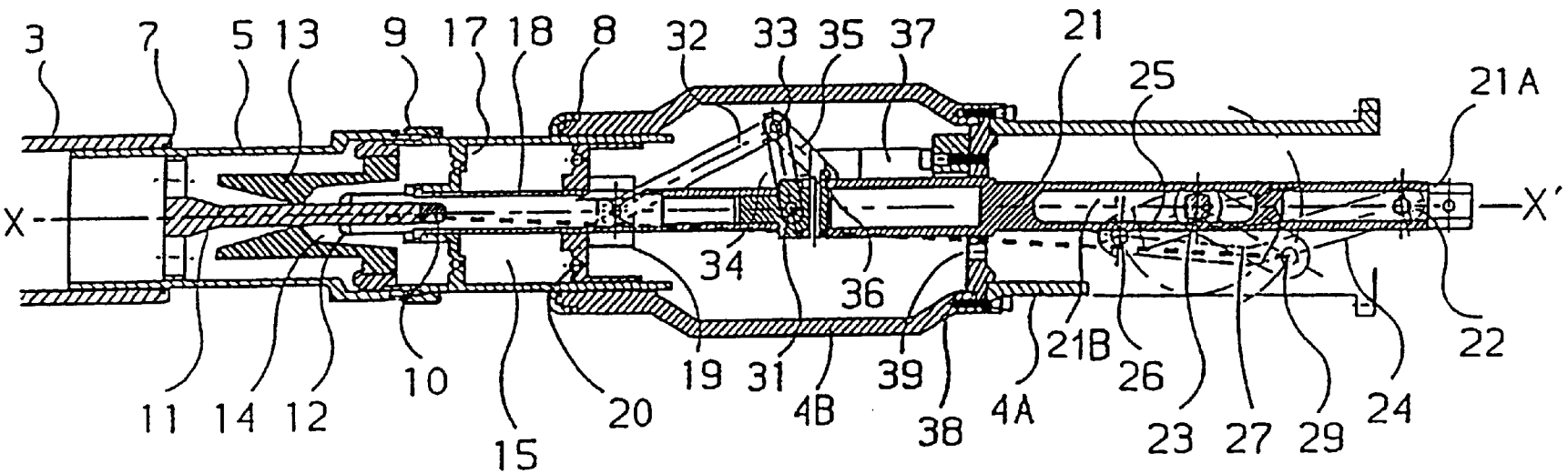

To clarify the drawings, the first linkage is shown only symbolically in FIG. 2 and the second linkage is shown only in FIGS. 2 to 7 and not in FIG. 1.

In the embodiment of the invention shown in the various figures, the first drive linkage includes a first shaft 22 mounted transversely on the drive rod 21 near its actuator 21A and a second shaft 23 mounted transversely on the tube 4. The second shaft 23 passes through the drive rod 21, which to this end incorporates a longitudinal opening 21B of appropriate length, as shown in FIGS. 2 to 7.

The two shafts 22 and 23 are interconnected by a system of relatively long links 24 and relatively short links 25 so that movement of the drive rod 21 along the axis XX' rotates the shaft 23 in one direction or the other, depending on the direction of movement imposed on the drive rod.

In the embodiment considered, two identical cranked relatively long shaft actuator links 24 each have one end mounted at one end of the first shaft 22, about which they can turn. The other end of each of the relatively long links 24 is articulated in the same manner and by means of an individual shaft 26 to a relatively short shaft actuator link 25 at a first end of the latter. The two relatively short links 25 are identical and are fixed to the shaft 23 in the same manner, on respective opposite sides of the drive rod, which they adjoin, and each at a second of its ends. The assembly formed by the pairs of relatively long links 24, relatively short links 25 and shafts 26 is divided into two sub-assemblies accommodated in a first section of the tube 4, on respective opposite sides of the drive rod 21.

The shaft 23 rotates one way or the other according to the direction of movement imposed on the drive rod. Its rotation moves the moving contact assembly which is carried by the conductive member 5 and which essentially consists of the annular permanent contact member 9, the conductive termination 10 and the wear contact rod 11. To this end, two identical relatively short moving assembly drive links 27 are fixed in the same manner to the shaft 23, on respective opposite sides of the tube 4, which they adjoin, and each by a first end. Two identical rectilinear relatively long moving assembly drive links 28 each have a first end articulated to a second end of one of the relatively short links 27 by an individual articulation axis 29.

The respective second ends of the relatively long links 28 are articulated to the member 5 by means of shafts 30 positioned diametrally on respective opposite sides of that member. In the example shown, each relatively long link 28 consists of several parts, essentially a connecting rod at the ends of which are formed or mounted the arrangements for articulating the rod to the shafts 29 and 30.

The second linkage, which drives the movements of the compression piston 19, is positioned inside the second tube section 4, between the first tube section and the compression piston 19, whose movements it drives. As shown in FIG. 2, the linkage includes a drive shaft 31 mounted transversely on the drive rod 21 so that it can move with that rod 21 in the second tube section 4B and along the axis XX' when the rod moves between its two extreme positions. The movement to compress the gas between the compression piston 19 and the separator wall 17 and the corresponding return movement are obtained by the action of a relatively long compression link 32 or preferably by the action of a pair of relatively long compression links 32. To this end, each relatively long link 32 has a first end articulated to the compression piston 19 by a central shaft of which only the position I is shown in FIG. 2, the articulation being omitted to clarify the figure. It is of a conventional type.

An individual shaft 33 at the second end of each relatively long link 32 provides an articulation for a first end of two relatively short links 34 and 35, one of which drives the movements of the relatively long link 32 and the other of which monitors them. To the end, each relatively long link 34 is articulated at its second end to the drive shaft 31 carried by the drive rod 21. Similarly, the second end of each relatively short link 35 is articulated to a fixed shaft 36 carried by a support member 37. The member 37 is mounted on a wall element 38 which is fixed between the first tube section and the second tube section 4B and which forms a central sliding support bearing surface for the drive rod 21. The shafts 31 and 36 can instead each take the form of a single shaft, or two half-shafts, and an individual shaft 33 is provided for each of the sub-assemblies of a relatively long link 32 and two relatively short links 34, 35 of the second linkage. In a preferred embodiment of the invention the two sub-assemblies are on respective opposite sides of the tube 4 containing the drive rod.

One or more passages 39 for the dielectric gas are provided in the wall element 38. The gas is compressed in the chamber 15 before it is puffed to extinguish the arc at the wear contact.

FIGS. 2 to 7 show various characteristic and successive stages of the opening of one circuit-breaker pole according to the invention.

When the semi-moving and moving contact assemblies of the circuit-breaker pole are interconnected, the members 5 and 6 are moved towards each other by the action of the drive rod 21 in the position fully inserted into the tube 4. This maximum insertion means that the member 6 and the permanent and wear contact members that it incorporates are in a fully inserted position and are electrically connected to the permanent and wear contact members carried by the member 5, which are themselves in their fully inserted position, as shown in FIG. 2.

To this end, each articulation shaft 26 between a relatively long shaft actuator link 24 and a relatively short link shaft actuator 25 is in a fully inserted position inside the tube 4 in which it is close to the drive rod. Its movement towards the rod is limited by the relatively long link 24 bearing against the shaft 23. In the embodiment described, the relatively long shaft actuator links 24 are therefore identically cranked where they bear against the shaft 23 in this fully inserted position of the drive rod 21, to provide the required maximum amplitude of movement with minimum lengths of the relatively long links 24 and the relatively short links 25.

Each of the relatively short moving assembly drive links 27 is at an obtuse angle (for example an angle of the order of 130°) to the corresponding relatively short link 25 where they are fixed to the shaft 23. The shafts 26 and 29 respectively carried by these relatively short links are therefore on the same side of the rod 21, under the rod in FIG. 2.

The compression piston 19 is then at the maximum distance from the separator wall 17, which it subsequently moves towards to compress the gas contained between them.

The drive shaft 31 is then in its position of maximum insertion into the second section of the tube 4, because of the maximum insertion of the drive rod 21. As a result of this, the shaft 33 is at a maximum distance from the drive rod 21 so that the compression piston is at a minimum distance from the shaft 31.

Figure 3:
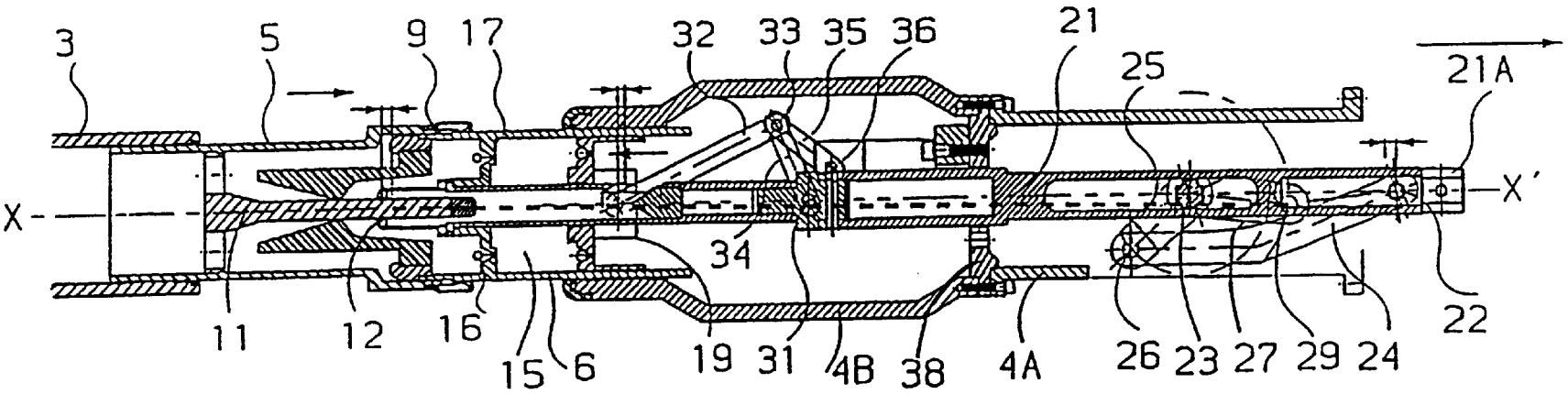
FIG. 3 is a longitudinal section of the same pole, corresponding to that of FIG. 2, during a first stage of opening the circuit-breaker.

Pulling the drive rod 21 out of the tube 4 initially causes simultaneous movement of the two contact assemblies in the same direction, as shown in FIG. 3. Pulling the rod 21 moves the rod in the same direction as the semi-moving assembly whose member 6 is inserted into the tube 4. This movement of the drive rod 21 pulls the relatively long actuator links 24 on the articulation shafts 26 and rotates the shaft 23. This rotation moves the shafts 29 carried by the relatively short links 27 towards to the axis XX' of the drive rod 21 and the relatively long links 28 pull on the member 5 in the direction of movement of the rod 21. The moving assembly of which the member 5 is a part therefore tends to follow the semi-moving assembly until the shafts 29 are in the same plane as the axis XX', as shown in FIG. 3.

Figure 4:
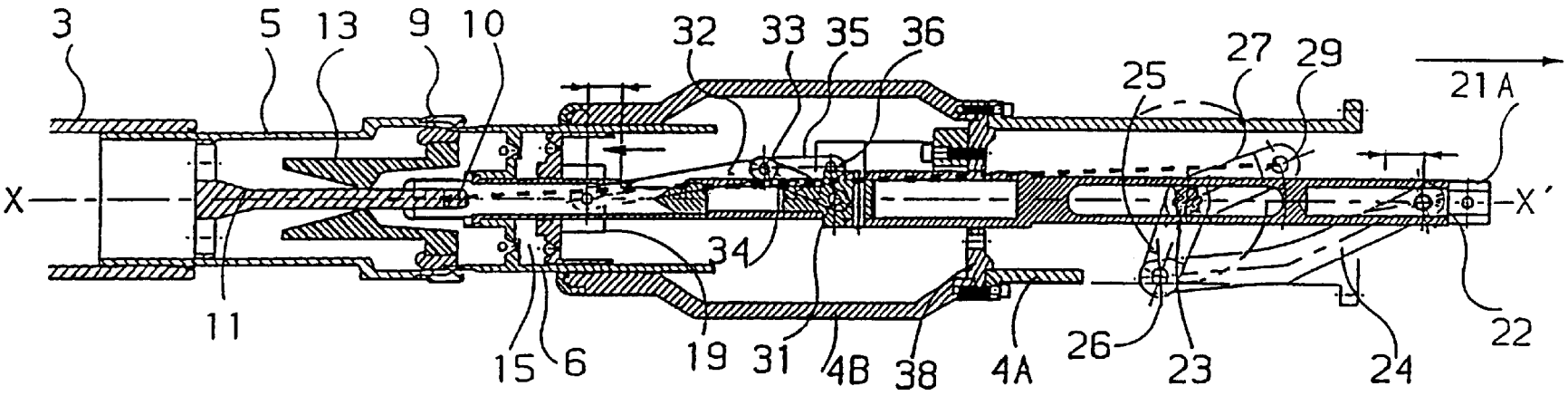
FIGS. 4, 5 and 6 are longitudinal sections corresponding to that of FIG. 2 for three successive intermediate stages of opening the circuit-breaker.

Pulling the drive rod 21 also tends to move each individual shaft 33 towards the axis XX' of the rod with a component along that axis which moves the piston 19 towards the separator wall 17. The gas contained between the piston and that wall is compressed until the pressure is sufficient to open the valves 16 to enable the pressurized gas to flow into the expansion volume 14, as shown in FIG. 4 in particular.

Figure 5:
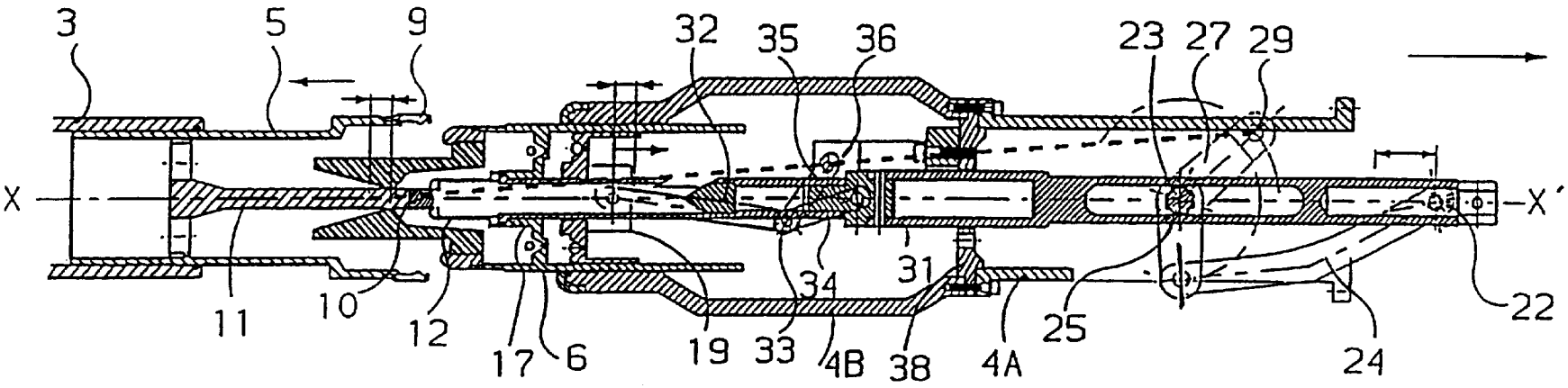

Further pulling of the drive rod then moves the moving assembly in the opposite direction to the semi-moving assembly driven directly by the drive rod 21 carrying it, as shown in FIG. 5, as soon as the simultaneous movement of the shafts 26 takes them to the other side of the plane passing through the axis XX' previously referred to, relative to the shafts 26. The magnitude of the component of movement of the shafts 29 along the axis XX' under these conditions is reflected in an increase in the speed with which the moving assembly and the semi-moving assembly are separated, which separation is linked to the movement of the moving assembly.

Because of the movements of the members 5 and 6 in opposite directions, the annular permanent contact member 9 of the member 5 slides on the permanent contact member formed by the outside wall of the tube formed by the member 6. The permanent contact of the pole is opened and the annular permanent contact member 9 carried by the member 5 leaves the outside surface of the member 6, with the result that electrical continuity is then provided only by the wear contact.

Pulling the rod 21 farther to extract it from the tube 4 causes the piston 19 to move towards the separator wall 17 and practically to empty the compression chamber 15, and the articulation shaft 33 common to a relatively long link 32 and a relatively short link 34 moves to the other side of the associated drive shaft 31 relative to the associated shaft 36, after which the relatively long link and the relatively short link pass through an aligned position.

The wear contact is opened when the traction applied to the drive rod 21 causes each of the relatively short shaft actuator links 25 to move towards the rod 21, after crossing the plane perpendicular to the axis XX' passing through the shaft 23. This opening is causes by the movements in opposite directions of the drive rod 21 and the member 5, in the latter case because of the thrust applied by the relatively long moving assembly drive links 28. This breaks the electrical connection at the termination 11 when the latter ceases to be in contact with the wear contact member 12. The compressed dielectric gas contained in the expansion volume 14 is then evacuated through that contact member and the hollow rod 18 extending it, because of the pressure difference between the expansion volume and the interior of the tube 4 with which the hollow rod communicates. The blowing effect of this evacuation interrupts the electrical continuity between the termination 11 and the wear contact member 12 temporarily provided by an electric arc.

The wear contact can be opened relatively slowly, to prevent the arc fingers greatly overlapping the termination 10 if a closure resistance is provided and it is beneficial to facilitate its insertion.

In one embodiment of the invention, the speeds at which the two assemblies separate when the wear contact opens, at which time the operation of compressing the gas has finished, are practically equal.

Figure 6:
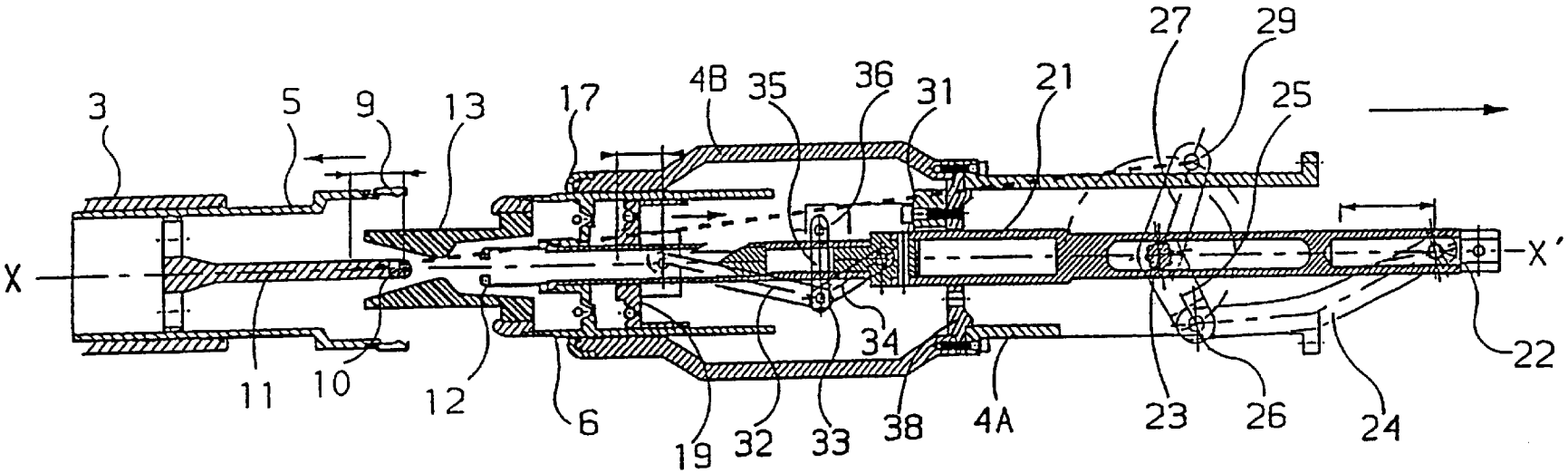

Separation continues because further traction is applied to the drive rod, as shown in FIG. 6, where the termination 11 is extracted sufficiently from the arc blast nozzle 13 for the end wall of the arc expansion volume 14 to be open.

Figure 7:
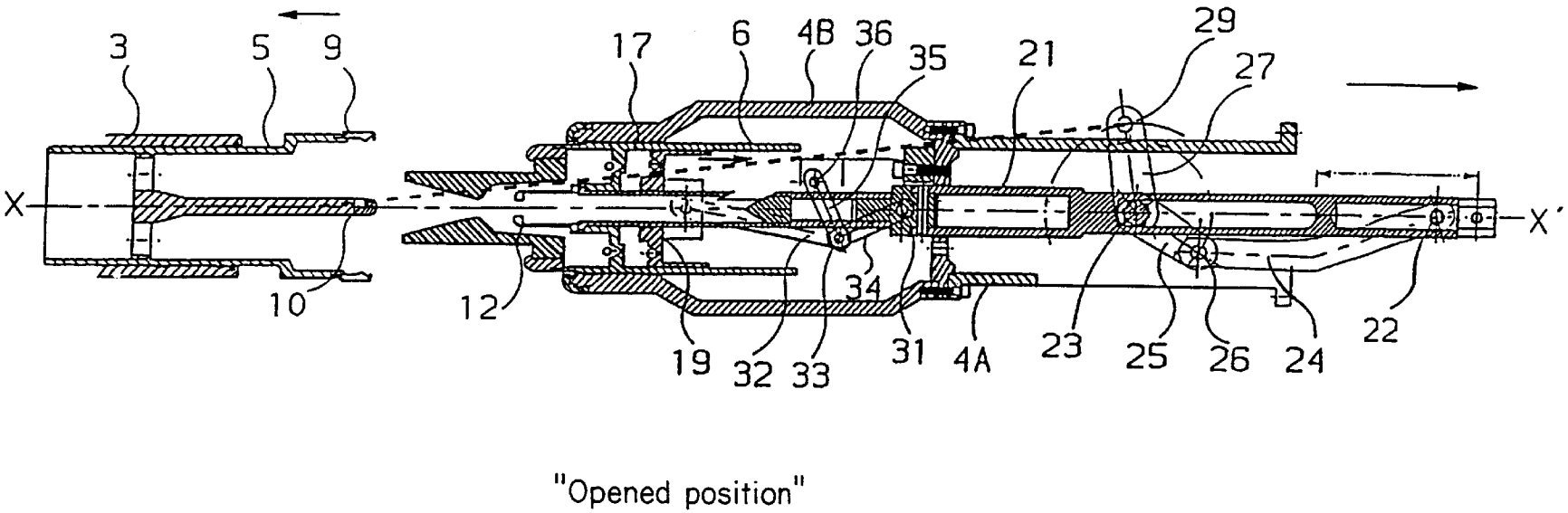
FIG. 7 is a longitudinal section corresponding to that of FIG. 2, showing the circuit-breaker pole in the tripped or open state.

An open state shown diagrammatically in FIG. 7 is obtained when the drive rod 21 has been pulled into an extreme opening position relative to the tube 4 for which the traction applied through the intermediary of the relatively long actuator links 24 becomes inoperative.

The pole of the circuit-breaker is then returned to the armed state by moving the drive rod in the opposite direction to move the two assemblies and the compression piston to the position they initially occupied, shown in FIG. 1.

What is claimed is:

1. A dual contact motion multi-pole high-voltage circuit-breaker in which each pole includes a case (1) defining a break chamber (2) to be filled with dielectric gas, said circuit-breaker comprising:

two aligned conductive tubes (3, 4) each connected to a different external connection terminal;

a semi-moving assembly and a moving assembly which move along a common axis and are interconnected by a wear contact member and a permanent contact member, wherein the semi-moving assembly includes the permanent contact member and the moving assembly includes the wear contact member;

said permanent contact member including an outside wall of a first conductive member (6) for sliding inside an annular permanent contact member (9) of the moving assembly, said annular permanent member electrically connected to a wall of one of the fixed tubes (4) and carried by a second conductive member (5) adapted to slide in the other fixed tube (3) to which said second conductive member is electrically connected, and said wear contact member including a conductive termination (10) mounted at the end of a conductive support rod (11) fixed axially inside said second conductive member, said rod for penetrating axially into an arc blast nozzle (13), which it then blocks and which defines an arc expansion volume (14) around a wear contact (12) which is complementary to the conductive termination and carried axially by the first conductive member of the semi-moving assembly, as well as said nozzle which is fixed to the end of said first conductive member at a border of the expansion volume, for filling with gas through a wall (17) which separates said expansion volume from a compression chamber (15) formed in the first conductive member between said wall and a compressor piston (19) moved with the semi-moving and moving assemblies; and a drive rod (21) disposed axially in the semi-moving assembly and movable in translation between a fully inserted position in which the first conductive member and the second conductive member of the semi-moving and moving assemblies are interconnected and a fully open position in which the first conductive member and the second conductive member of the semi-moving and moving assemblies are separated, the drive rod carrying the first conductive member (6) of the semi-moving assembly and co-operating with a first linkage (22 to 30) through which said second conductive member (5) of the moving assembly is driven, said first linkage for causing, when the drive rod is pulled from its fully inserted position, an initial displacement of the semi-moving and moving assemblies in the same direction as the rod, followed by movement of the moving assembly in the opposite direction to the semi-moving assembly, after said moving assembly has stopped and until the drive rod reaches its open position, after separation of the first conductive member and the second conductive member, and wherein said drive rod co-operates with a second linkage (31 to 36) which drives a compressor piston in the opposite direction relative to said first conductive member (6), on which it slides, until the first conductive member and the second conductive member are separated.

2. A circuit-breaker according to claim 1, wherein the first linkage moves the semi-moving and the moving assemblies at the same speed in opposite directions when the first conductive member and the second conductive member are separated.

3. A circuit-breaker according to either claim 1, wherein the first linkage includes:

a first shaft (22) mounted transversely on the drive rod (21) near the actuator end (21A) of the drive rod, a second shaft (23) mounted transversely on the conductive tube (4) through which the rod passes, the rod incorporating a longitudinal opening (21B) through which the shaft passes, a system including at least one relatively long shaft actuator link (24) and one relatively short shaft actuator link (25) which are articulated and connect the first and second shafts so that any movement of the rod causes corresponding rotation of the second shaft, and a system including at least one relatively short moving assembly drive link (27) and one relatively long link (28) connecting the second shaft to a shaft fastened to said other conductive member (5) which causes the moving assembly to move.

4. A circuit-breaker according to claim 3, wherein the relatively long and relatively short shaft actuator and moving assembly drive links are provided in pairs and form two sub-assemblies on respective opposite sides of the drive rod.

5. A circuit-breaker according to either claim 3, wherein a relatively long shaft actuator link (24) is cranked where it bears against the second shaft (23) in the fully inserted position of the drive rod in which the contacts are interconnected and in which a relatively short moving assembly drive link (27) is at an obtuse angle to the corresponding relatively short shaft actuator link (25) at the second shaft to which they are fixed, so that the two shafts (26 or 29) carried by each of them are on the same side of the drive rod (21) when the drive rod is in the fully inserted position and the relatively short shaft actuator link extends beyond the rod after limited displacement of the drive rod from the fully inserted position.

6. A circuit-breaker according to either claim 1, wherein the second linkage includes:

a drive shaft (31) mounted transversely on the drive rod (21), and a system including at least one relatively long compression link (32) and two relatively short compression links (34 and 35) articulated to a common shaft (33), said relatively long compression link being also articulated centrally to the compressor piston (19) and the relatively short compression links being respectively articulated to the drive shaft and to a fixed shaft (36).

7. A circuit-breaker according to claim 6, including a pair of relatively long compression links and two pairs of relatively short compression links which form two sub-assemblies on respective opposite sides of the tube (4) containing the drive rod.

* * * * *